United States Patent [19]

Yamamoto

[11] Patent Number: 4,695,675

[45] Date of Patent: Sep. 22, 1987

[54] ELECTRIC LEAD DEVICE FOR SUPERCONDUCTING ELECTRIC APPARATUS

[75] Inventor: Yuuichi Yamamoto, Kobe, Japan

[73] Assignee: Mitsubishi Denki Kabushiki Kaisha, Tokyo, Japan

[21] Appl. No.: 919,490

[22] Filed: Oct. 16, 1986

[30] Foreign Application Priority Data

Oct. 17, 1985 [JP] Japan ..... 60-157834

[51] Int. Cl.[4] ..... H01F 7/24

[52] U.S. Cl. ..... 174/15 CA; 335/216

[58] Field of Search ..... 174/15 BH, 15 C, 15 CA, 174/15 S; 335/216; 65/55.5, 514 R, 514 JT; 165/146

[56] References Cited

U.S. PATENT DOCUMENTS 3,317,651 5/1967 Deiness ..... 174/15 C
4,625,193 11/1986 Purcell ..... 335/216

FOREIGN PATENT DOCUMENTS 52-144676 11/1977 Japan ..... 174/15 CA
58-35908 3/1983 Japan .
60-173883 9/1985 Japan .

*Primary Examiner*—Laramie E. Askin

*Attorney, Agent, or Firm*—Leydig, Voit & Mayer

[57] ABSTRACT

An improved electric lead device for a superconducting electric apparatus particularly suited for small current ratings is disclosed in which the total cross sectional area of conductors disposed in a cylindrical lead housing formed of a metal pipe can be reduced from their normal temperature side toward their cryogenic temperature side without any difficulty while materially improving the cooling efficiency on the conductors. The electric lead device comprises: a coolant tank for storing therein a cryogenic coolant; a superconducting electric apparatus disposed in the coolant tank; a lead housing secured to the coolant tank and communicating with the interior of the coolant tank for introducing therein coolant gas vaporized from the cryogenic coolant; and conductors received in the lead housing and extending from a normal temperature side to a cryogenic temperature side for electrically connecting the superconducting electric apparatus to the outside, the conductors being constructed such that the total cross sectional area of the conductors decreases from the normal temperature side toward the cryogenic temperature side. The conductors are formed of conductor wire elements each covered with an electrically insulating layer.

6 Claims, 6 Drawing Figures

ELECTRIC LEAD DEVICE FOR SUPERCONDUCTING ELECTRIC APPARATUS

BACKGROUND OF THE INVENTION

1. Field of the Invention

This invention relates to an electric lead device for superconducting electric apparatus, and more specifically, to such an electric lead device adapted to connect a superconducting electric apparatus disposed in cryogenic equipment to the outside.

2. Description of the Prior Art

There has been known a conventional electric lead device for superconducting electric apparatus which is illustrated in FIGS. 5 and 6, and which is disclosed, for example, in Japanese Utility Model Application Laid Open No. 52-144676. In FIG. 5, a vertical section of a portion of the conventional electric lead device is shown in which the upper portion is at a normal temperature side and the lower portion is at a cryogenic temperature side. The conventional lead device illustrated includes a plurality of conductors 1 received in a lead housing 2 formed of a metal pipe which is provided on its inner surface with an insulation layer 3 for effecting electric insulation between the conductors 1 and the lead housing 2. The conductors 1 are supported by electrically conductive discs 4 secured on their annular outer peripheries to the inner surface of the lead housing 2 through the insulation layer 3. Each of the electrically conductive discs 4 has a plurality of first small holes 5 formed therethrough into which the conductors 1 are inserted so as to be supported by the discs 4, and a plurality of second small holes 6 formed therethrough for passage of a coolant gas such as helium in the lead housing 2, the coolant gas being vaporized from a cryogenic coolant stored in a coolant tank (not shown) disposed below the lead housing 2.

With the above-described construction, coolant gas such as low temperature helium vaporized from the cryogenic coolant stored at cryogenic temperatures in the coolant tank (not shown) located below the lead housing 2 passes upwards through the second holes 6 in the discs 4 and removes electric resistance heat created in the conductors 1 as well as conduction heat conducted from the normal temperature portion located above the lead housing 2. In this connection, due to the fact that the lower the temperature of the conductors 1 is, the smaller the electric resistance thereof becomes, the conductors 1 are constructed so that the total cross sectional area of the conductors 1 decreases from the normal temperature side (the upper end in FIG. 5) toward the cryogenic temperature side (the lower end in FIG. 5) thereof so as to reduce heat conduction from the normal temperature side toward the cryogenic temperature side through the conductors 1 to thereby minimize the total amount of heat transmission of electric resistance heat and conduction heat through the conductors 1.

With a conventional electric lead device as constructed above, the greatest cross sectional area of the conductors 1 at their higher temperature side is limited particularly in case of a lead device for a small current rating, and hence it is difficult or substantially impossible to further reduce the cross sectional area of the conductors 1 at their cryogenic temperature side. Moreover, the cooling efficiency of the vaporized coolant gas such as helium in the lead housing 2 relative to the conductors 1 is determined by the cross sectional area of the conductors 1 so that reduction in cross sectional area of the conductors 1 results in decreased cooling efficiency.

SUMMARY OF THE INVENTION

In view of the above, the present invention is intended to obviate the above-described problems of the prior art, and has for its object the provision of a novel and improved electric lead device for a superconducting electric apparatus of the kind described above which is particularly suited for small current ratings, and in which the total cross sectional area of conductors in a lead housing can be reduced from their normal temperature side toward their cryogenic temperature side without any difficulty while materially improving the cooling efficiency on the conductors.

In order to achieve the above-described object, according to the present invention, there is provided an electric lead device for a superconducting electric apparatus which comprises:

a coolant tank for storing therein a cryogenic coolant;

a superconducting electric apparatus disposed in the coolant tank;

a lead housing secured to the coolant tank and communicating with the interior of the coolant tank for introducing therein coolant gas vaporized from the cryogenic coolant; and conductor means received in the lead housing and extending from a normal temperature side to a cryogenic temperature side for electrically connecting the superconducting electric apparatus to the outside, the conductor means being constructed such that the total cross sectional area of the conductor means decreases from the normal temperature side toward the cryogenic temperature side, the conductor means being formed of conductor wire elements each covered with an electrically insulating layer.

In one embodiment, the conductor means comprises a plurality of conductors having different lengths from each other connected at their one end with a connector terminal means mounted on the lead housing, the shorter ones of the conductors being electrically connected at their other end with the longest one of the conductors.

In this case, the conductors may be electrically joined together at plural locations on the longest one of the conductors.

A plurality of electrically insulating members may be mounted on the longest one of the conductors at the plural locations at which the conductors are joined together so as to surround the joined portions thereof.

In another embodiment, the number of the conductor wire elements decreases from the normal temperature side toward the cryogenic temperature side.

In a further embodiment, the diameter of each of the conductor wire elements decreases from the normal temperature side toward the cryogenic temperature side.

The above and other objects, features and advantages of the present invention will become apparent from the following detailed description of the presently preferred embodiments of the invention when taken in conjunction with the accompanying drawings.

BRIEF DESCRIPTION OF THE DRAWINGS

FIGS. 1 through 3 show an electric lead device for a superconducting apparatus in accordance with a preferred embodiment of the invention in which;

FIG. 1 is a side elevational view, in cross section, of the electric lead device;

FIG. 2 is a side elevational view of the conductors shown in FIG. 1;

FIG. 3 is an enlarged cross sectional view of one of the conductors;

DESCRIPTION OF THE PREFERRED EMBODIMENTS

Figure 1:
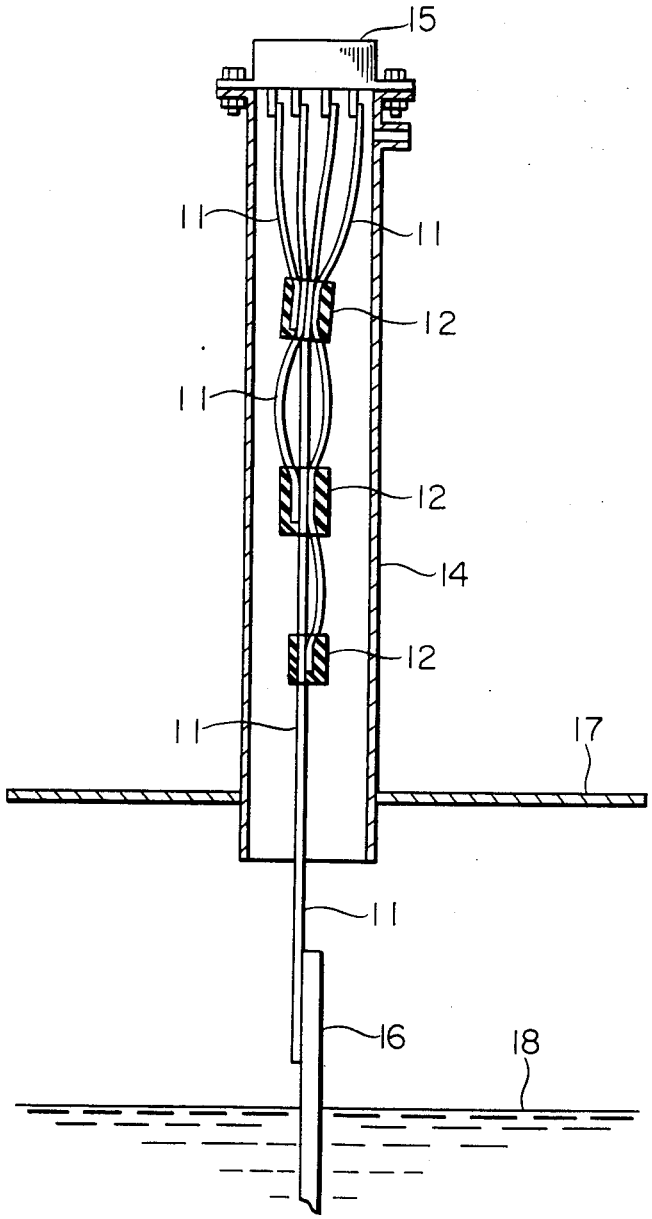
Figure 2:
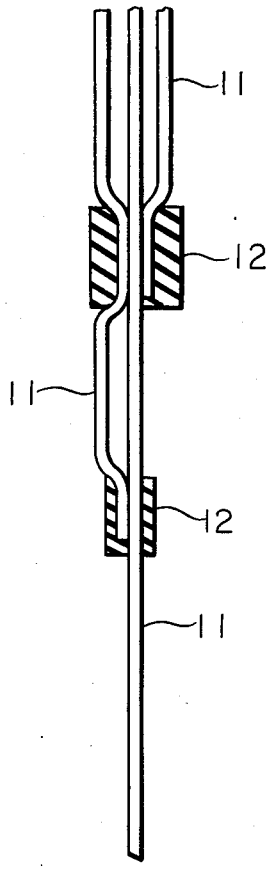
Figure 3:
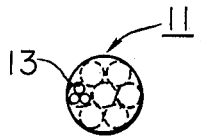

Now, the present invention will be described with reference to presently preferred embodiments thereof as illustrated in FIGS. 1 through 3.

In FIG. 1, there is shown an electric lead device for a superconducting electric apparatus constructed in accordance with the principles of the present invention which includes a cylindrical lead housing 14 in the form of a metal pipe fixedly mounted upright at its lower end on a coolant tank 17 which stores a cryogenic coolant 18 such as liquid helium and in which a superconducting electric apparatus such as a superconducting coil (not shown) is installed. The cylindrical lead housing 14 has its lower open end inserted into the coolant tank 17 to terminate at a location above the liquid coolant 18 in the coolant tank 17, and its upper end is closed by a terminal cap 15 bolted thereto.

Disposed in the cylindrical lead housing 14 are conductors 11 which are secured at their upper ends to lead terminals mounted on the cap 15 and extend downwards therefrom with their single lower common end secured to a lead line 16 leading to a cryogenic apparatus such as a superconducting coil (not shown) disposed in the coolant tank 17. As shown in FIG. 1, the number of the conductors 11 decreases stepwise from four at the normal temperature side (the upper end in FIG. 1) to one at the cryogenic temperature side (the lower end in FIG. 1), that is the total cross sectional area of the conductors 11 decreases from the normal temperature side toward the cryogenic temperature side thereof so as to reduce the thermal conduction through the conductors 11 from the normal temperature side toward the cryogenic temperature side.

According to the present invention, the conductors 11 in the cylindrical lead housing 14 are constructed in the following manner. As clearly seen from FIGS. 2 and 3, each of the conductors 11 is formed of a plurality of stranded wire elements such as copper wire elements each covered with an electrically insulating layer and twisted together. The conductors 11 are different in length from each other and the shorter ones, being electrically secured at their upper ends to respective connector terminals mounted on the cap 15, as shown in FIG. 1, are electrically joined at their intermediate points and/or lower ends to the longest conductor as by soldering with the electrically insulating covering layers removed, as illustrated in FIG. 2, whereby the total cross sectional area of the conductors 11 is reduced from the normal temperature side toward the cryogenic temperature side, as referred to above. Those portions of the conductors 11 which are joined together as by soldering are enclosed or covered by electrically insulating members 12 so that they are electrically insulated from the lead housing 14.

With this construction, coolant gas such as low temperature helium, vaporized from the liquid coolant such as liquid helium 18 at cryogenic temperatures stored in the coolant tank 17 and flowing into the lead housing 14, can enter inbetween the respective wire elements 13 of each conductor 11 without difficulty, thereby removing the conduction heat to be conducted from a normal temperature side toward a cryogenic temperature side through the conductors 11 as well as the electric resistance heat generated by electric current flowing therethrough. In this connection, it is to be noted that the total sum of the conduction heat and the electric resistance heat is substantially reduced for the reason that the total cross sectional area of the conductors 11 decreases from the normal temperature side toward the cryogenic temperature side so as to reduce thermal conduction through the conductors 11, and that the electric resistance of the conductors 11 decreases in accordance with the decreasing temperature thereof.

Figure 4:
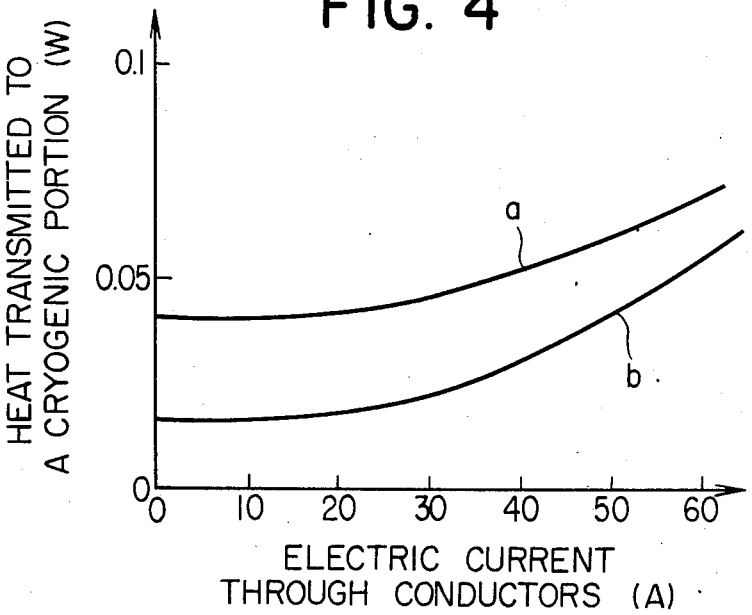
FIG. 4 is a graphic representation of comparative characteristic curves respectively showing a relationship between the heat transmitted to a cryogenic portion and the electric current through the conductors.
Figure 5:
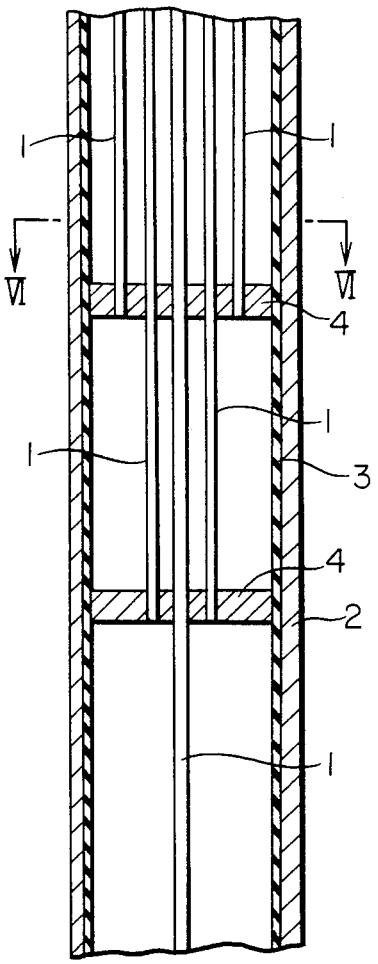
FIG. 5 PRIOR ART
FIG. 5 is a vertical cross sectional view showing an essential part of a conventional lead device for a superconducting electric apparatus.
Figure 6:
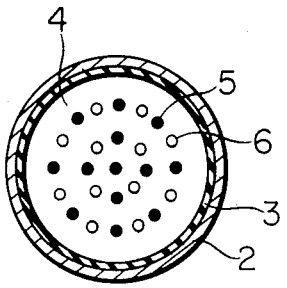
FIG. 6 PRIOR ART
FIG. 6 is a cross sectional view taken along the line VI—VI in FIG. 5.

FIG. 4 is a graphic representation showing relationships between the intensity of electric current (Amperes) running through the conductors 11 and the quantity of heat (Watts) transmitted through the conductors 11 to a cryogenic temperature portion or the interior of the coolant tank 17. In this Figure, a characteristic curve a represents the above relationship with the conventional conductors 1 each formed of a single wire element of 0.4 mm diameter covered with an electrically insulating layer as illustrated in FIG. 5, and a characteristic curve b represents the above relationship with the conductors 11 of the present invention each formed of 16 wire elements twisted together, each of the wire elements being of 0.1 mm diameter and covered with an electrically insulating layer. From FIG. 4, it has been found that the thermal transmission characteristic of the lead conductors 11 of the present invention is greatly improved as compared with that of the conventional lead conductors 1.

Although in the above-described embodiment, the terminal cap 15 having the connector terminals is fluid-tightly attached to the upper end of the lead housing 14, other types of terminals may be used which need only to ensure fluid tightness of the interior of the lead housing 14 against the outside. Also, in the above embodiment, the present invention has been applied to the superconducting coil but may likewise be applicable to other types of cryogenic electric apparatus.

Moreover, instead of the soldering employed in the above embodiment, the conductors 11 may be electrically connected with each other by other electrically connecting means. In addition, in the above embodiment, the number of the conductors 11 has been decreased gradually from the normal temperature side toward the cryogenic temperature side for the purpose of reducing the total cross sectional area of the conductors 11 in the same direction, but it may be possible to reduce the number of conductor wire elements constituting the conductors or the diameter of each conductor wire element from the normal temperature side toward the cryogenic temperature side for attaining the same results. Also, the twisting structure and/or number of the conductor wire elements are not limited to those of the illustrated embodiment but may be selected or changed arbitrarily as necessary.

As described in the foregoing, according to the present invention, each of lead conductors connecting a superconducting electric apparatus of cryogenic temperatures to the outside of normal temperatures is formed of a plurality of conductor wire elements each covered with an electrically insulating layer so that the cooling efficiency of the lead device by vaporized coolant gas is remarkably improved, thus realizing a lead device of high cooling efficiency particularly adapted for use with low current ratings.

What is claimed is:

1. An electric lead device for a superconducting electric apparatus comprising:

a coolant tank for storing therein a cryogenic coolant;

a superconducting electric apparatus disposed in said coolant tank;

a lead housing secured to said coolant tank and communicating with the interior of said coolant tank for introducing therein coolant gas vaporized from said cryogenic coolant; and conductor means received in said lead housing and extending from a normal temperature side to a cryogenic temperature side for electrically connecting said superconducting electric apparatus to the outside, said conductor means being constructed such that the total cross sectional area of said conductor means decreases from said normal temperature side toward said cryogenic temperature side, said conductor means being formed of conductor wire elements each covered with an electrically insulating layer.

2. An electric lead device for a superconducting electric apparatus as set forth in claim 1, further comprising connector terminal means mounted on said lead housing, and wherein said conductor means comprises a plurality of conductors having different lengths from each other and being connected at their one end with said connector terminal means, the shorter ones of said conductors being electrically connected at their other end with the longest one of said conductors.

3. An electric lead device for a superconducting electric apparatus as set forth in claim 2, wherein said conductors are electrically joined together at plural locations on the longest one of said conductors.

4. An electric lead device for a superconducting electric apparatus as set forth in claim 3, further comprising a plurality of electrically insulating members mounted on the longest one of said conductors at said plural locations at which said conductors are joined together so as to surround the joined portions thereof.

5. An electric lead device for a superconducting electric apparatus as set forth in claim 1, wherein the number of said conductor wire elements decreases from said normal temperature side toward said cryogenic temperature side.

6. An electric lead device for a superconducting electric apparatus as set forth in claim 1, wherein the diameter of each of said conductor wire elements decreases from said normal temperature side toward said cryogenic temperature side.

* * * * *